United States Patent [19]

Pearson

[11] 4,108,153

[45] Aug. 22, 1978

[54] QUICK EXTINGUISHING ASH TRAY

[75] Inventor: Edward K. Pearson, Cold Spring Harbor, N.Y.

[73] Assignee: The Raymond Lee Organization, Inc., New York, N.Y.

[21] Appl. No.: 782,426

[22] Filed: Mar. 29, 1977

[51] Int. Cl.[2] ..... A24F 13/18; A24F 19/14

[52] U.S. Cl. ..... 131/235 R; 131/240 R; 131/260

[58] Field of Search ..... 131/235 R, 231, 240 R, 131/240 GG, 260, 257; D27/8, 27

[56] References Cited

U.S. PATENT DOCUMENTS

| | | | |
|---|---|---|---|
| 1,710,957 | 4/1929 | RItzwoller | 131/235 R |
| 1,917,491 | 7/1933 | Bowerman | 131/231 |
| 2,199,205 | 4/1940 | Litschgi | 131/235 R |
| 2,771,080 | 11/1956 | Cole | D27/27 X |
| 2,781,651 | 2/1957 | Cutler | 131/240 R X |

*Primary Examiner*—Stephen C. Pellegrino
*Attorney, Agent, or Firm*—Howard I. Podell

[57] ABSTRACT

An ash tray of circular shape formed with a circular projecting flange bounding an annular recess, in which sand may be placed, with a central cup section in which a bracket is fitted. The bracket is shaped with radial spokes, each terminating in an open ring of a size to fit a cigarette tip, with the spokes joined to a central open ring of a size to fit about a cigar tip. The spokes serve to hold a pipe of a varying size in place, depending on the placement of the pipe. The bracket is mounted to the inner sides of the cup so as to be raised above the bottom wall of the cup, to permit placement of sand in the cup bottom.

4 Claims, 4 Drawing Figures

QUICK EXTINGUISHING ASH TRAY

SUMMARY OF THE INVENTION

My invention is an ash tray of circular shape formed with a circular projecting flange bounding an annular recess, in which sand may be placed, with a central cup section in which a bracket is fitted. The bracket is shaped with radial spokes, each terminating in an open ring of a size to fit a cigarette tip, with the spokes joined to a central open ring of a size to fit about a cigar tip. The spokes serve to hole a pipe of a varying size in place, depending on the placement of the pipe. The bracket is mounted to the inner sides of the cup so as to be raised above the bottom wall of the cup, to permit placement of sand in the cup bottom.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
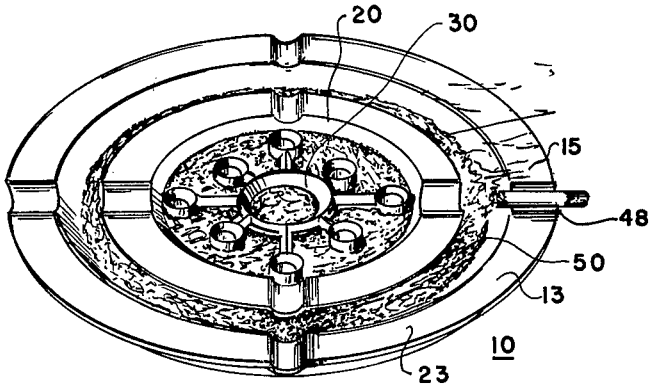
FIG. 1 is a perspective view of the invention.
Figure 2:
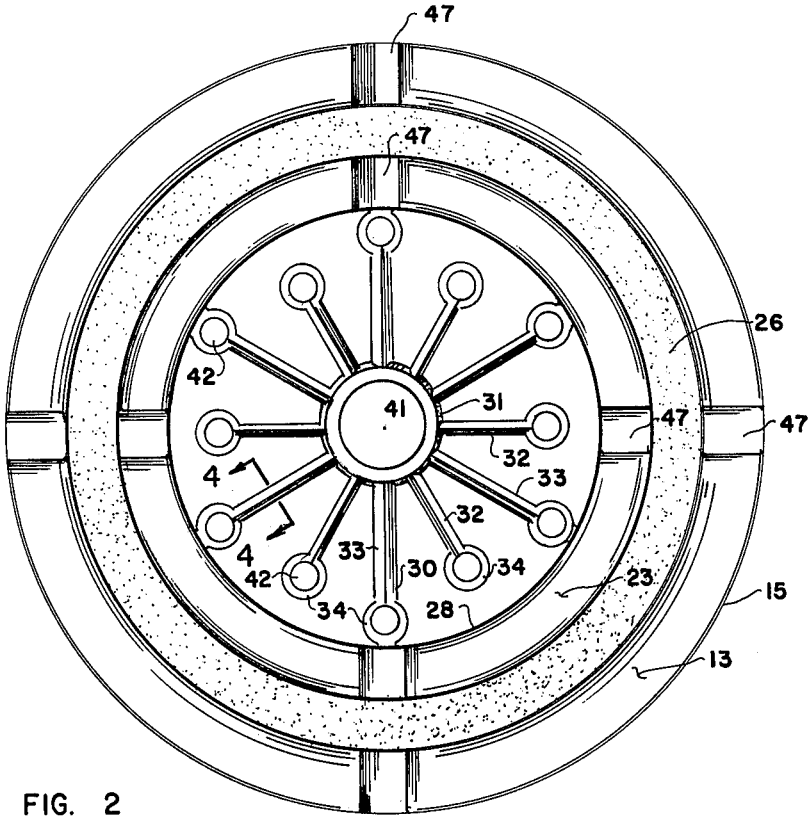
FIG. 2 is a plan view of the invention.
Figure 3:
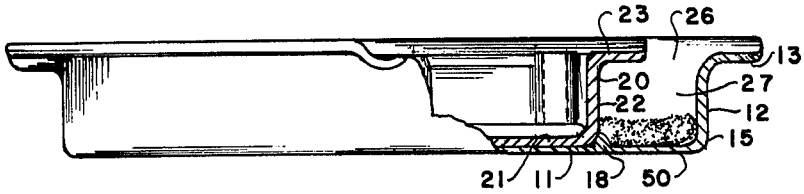
FIG. 3 is a sectional side view of the invention.

Turning now descriptively to the drawings, in which similar reference characters denote similar elements throughout the several views, FIGS. 1–3 illustrate the ash tray 10. An outer circular tray 15 is formed of a circular bottom wall 11 bounded by an upraised cylindrical side wall 12, joined at its top to a horizontal projecting flange 13.

An inner circular tray 20 of smaller diameter concentrically freely rests on bottom wall 11 of the outer tray and is held in place by an upraised circular rim 18 extending upwards from bottom wall 11 about the external surface of cylindrical side wall 22 of the inner tray.

Inner tray 20 is formed of a circular bottom wall 21 joined to side wall 22, with a horizontal flange 23 projecting outwardly from the top of the side wall 22 to extend short of side wall 12 of the outer tray to provide an annular opening 26 to the annular recess 27 between side walls 12 and 22 of the two trays.

A bracket 30 is fixed to the inner surface 28 of inner tray 20 above the bottom tray wall 21. Bracket 30 is formed of a central open ring 31 to which short radial spokes 32 and long radial apokes 33 are alternately fixed with each spoke 32, 33 terminating in an open ring 34. The rings 34 joined to the longer spokes 33 are joined to the inner wall 28 of tray 20 to support bracket 30 freely above bottom wall 21.

The circular hole 41 enclosed by central ring 31 is of a size to engage about the tip of a cigar, and the circular holes 42 enclosed by rings 34 are of a size to engage about the tip of a cigarette.

Figure 4:
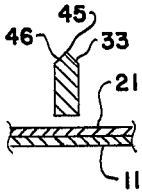
FIG. 4 is a sectional view, taken along line 4-4 of FIG. 2.

The spokes 32 and 33 are in triangular cross-section, as shown in FIG. 4, with the apex 45 pointed upwards so that the tapered side walls 46 of adjoining spokes will support the base of a pipe resting on adjacent spokes 32 and 33 permit placement of a pipe of a varying base size at a location of a range of width between the adjacent spokes.

Sand 50 or other non-combustible powdered material may be placed inside the outer tray on the bottom wall 11 in the annular recess 27 as well as on the bottom wall 21 of the inner tray, with the sand serving to extinguish ashes falling off a cigar or cigarette 48 resting on flanges 13 or 23. Cylindrical radially oriented recess 47 are formed in the flanges 13 and 23 for retention of a cigarette or cigar.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An ash tray formed of
an outer circular tray
an inner circular tray and
a bracket fitted inside the inner circular tray, in which the inner tray rests on the base of the outer tray, being positioned in place by upraised detent means on said base, said detent means located to provide an annular recess between the external walls of the inner and outer tray, with
said bracket formed of a central open ring member joined to outward radially projecting spokes, with each spoke terminating in an open ring, said bracket fixed to the side of the inner tray and positioned above the base of said inner tray.

2. The combination as recited in claim 1 in which sand is placed in the base of the outer tray in the annular recess.

3. The combination as recited in claim 1 in which the hole of the central ring is of a size to engage the tip of a cigar.

4. The combination as recited in claim 1 in which the hole of a spoke ring is of a size to engage a tip of a cigarette.

* * * * *